US008286600B2

(12) United States Patent
Riley et al.

(10) Patent No.: US 8,286,600 B2
(45) Date of Patent: Oct. 16, 2012

(54) ENGINE HAVING VARIABLE LIFT VALVETRAIN

(75) Inventors: William B. Riley, Fenton, MI (US); Robert Lionel Jacques, Troy, MI (US); Alan Edgar Bowler, Oxford, MI (US); Kevin M. Luchansky, Sterling Heights, MI (US)

(73) Assignee: GM Global Technology Operations LLC

( * ) Notice: Subject to any disclaimer, the term of this patent is extended or adjusted under 35 U.S.C. 154(b) by 312 days.

(21) Appl. No.: 12/728,526

(22) Filed: Mar. 22, 2010

(65) Prior Publication Data

US 2011/0226207 A1 Sep. 22, 2011

(51) Int. Cl.
*F01L 1/18* (2006.01)
*F01L 1/34* (2006.01)

(52) U.S. Cl. ..... 123/90.16; 123/90.44; 123/90.4

(58) Field of Classification Search ..... 123/90.16, 123/90.18, 90.4, 90.44
See application file for complete search history.

(56) References Cited

U.S. PATENT DOCUMENTS 4,386,590 A * 6/1983 Bates ..... 123/198 F
4,612,884 A * 9/1986 Ajiki et al. ..... 123/90.16
4,790,274 A 12/1988 Inoue et al.
4,844,023 A 7/1989 Konno et al.
4,869,214 A * 9/1989 Inoue et al. ..... 123/90.16
4,887,563 A * 12/1989 Ishida et al. ..... 123/90.16
4,942,853 A 7/1990 Konno
RE33,310 E 8/1990 Ajiki et al.
5,251,586 A 10/1993 Koga et al.
5,429,079 A 7/1995 Murata et al.
5,626,116 A * 5/1997 Reedy et al. ..... 123/321
6,810,844 B2 * 11/2004 Sellnau ..... 123/90.16
7,201,125 B2 4/2007 Evans et al.
7,565,887 B2 * 7/2009 Tsuruta et al. ..... 123/90.16
2006/0283412 A1 12/2006 Tsuruta et al.
2009/0064954 A1 * 3/2009 Manther ..... 123/90.44

* cited by examiner

*Primary Examiner* — Thomas Denion
*Assistant Examiner* — Steven D Shipe
(74) *Attorney, Agent, or Firm* — Harness, Dickey & Pierce, P.L.C.

(57) ABSTRACT

A rocker arm may include a first arm defining a first longitudinal bore and a second arm defining a second longitudinal bore. The rocker arm may house a locking assembly including a first actuation pin extending through a first radial passage in the rocker arm, a second actuation pin extending through a second radial passage in the rocker arm, and a first lock pin located in the first longitudinal bore between the first and second actuation pins. An actuation assembly may be engaged with the first and second actuation pins and may be linearly displaceable between first and second actuation positions. The first and second arms may be rotatable relative to one another when the actuation assembly is in the first actuation position and may be fixed for rotation with one another when the actuation assembly is in the second actuation position.

20 Claims, 7 Drawing Sheets

FIG 4
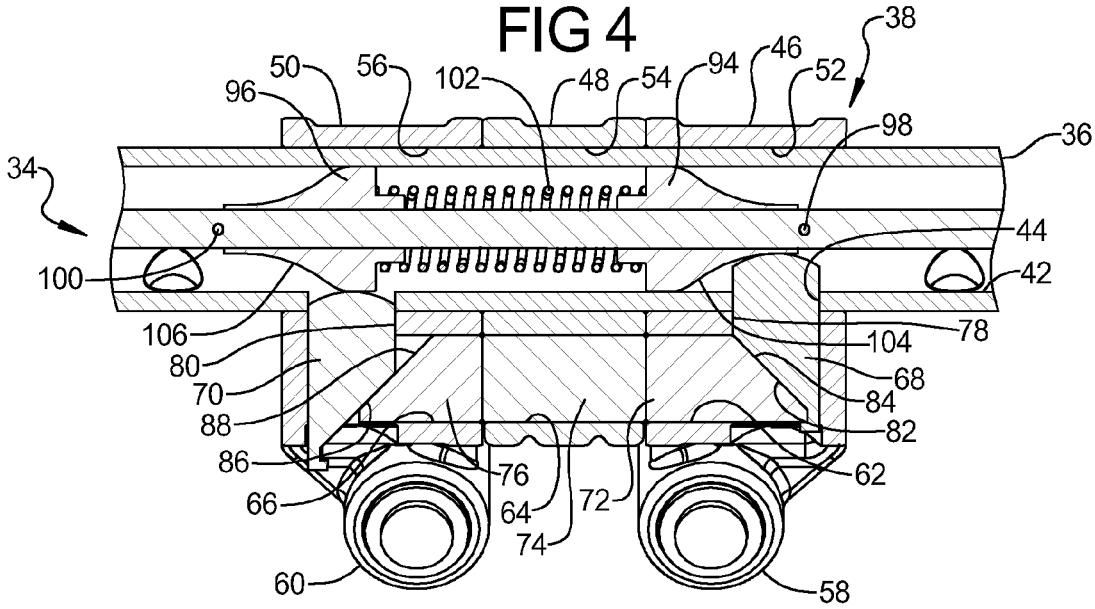
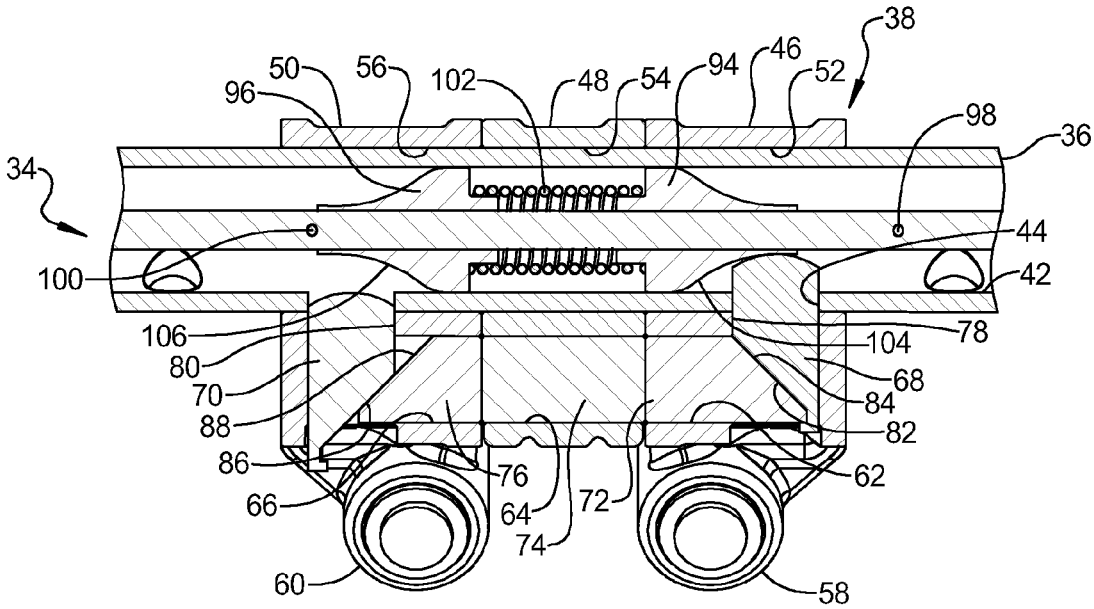
FIG 5

FIG 6
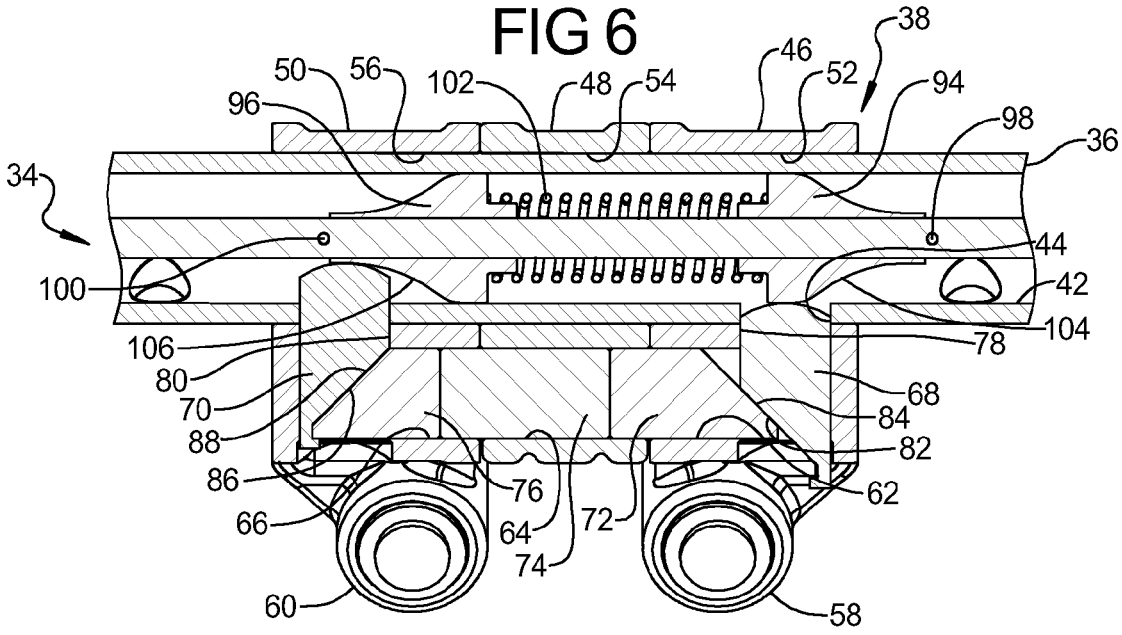
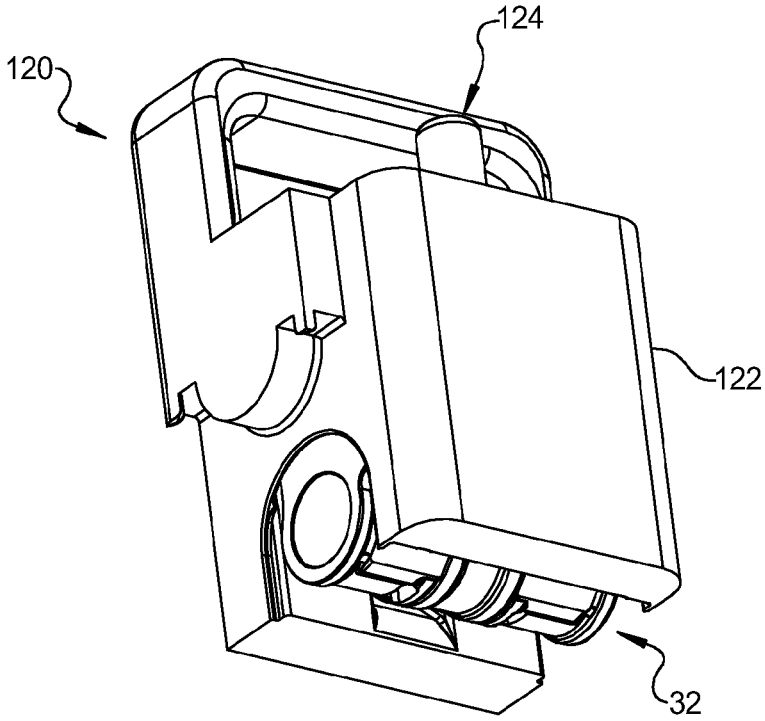
FIG 7

FIG 9
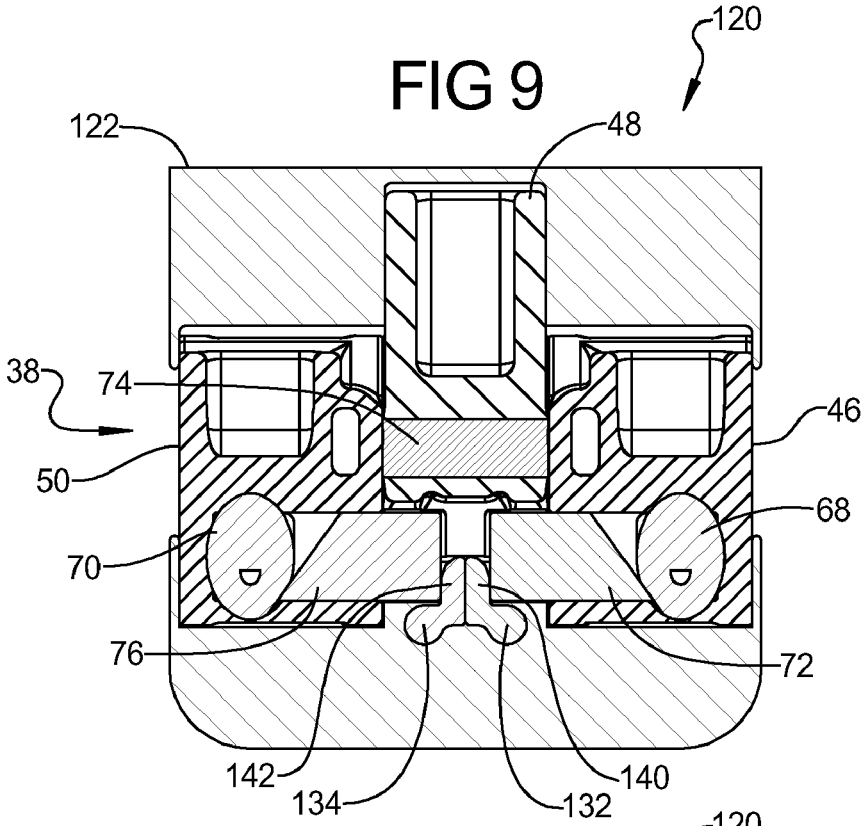
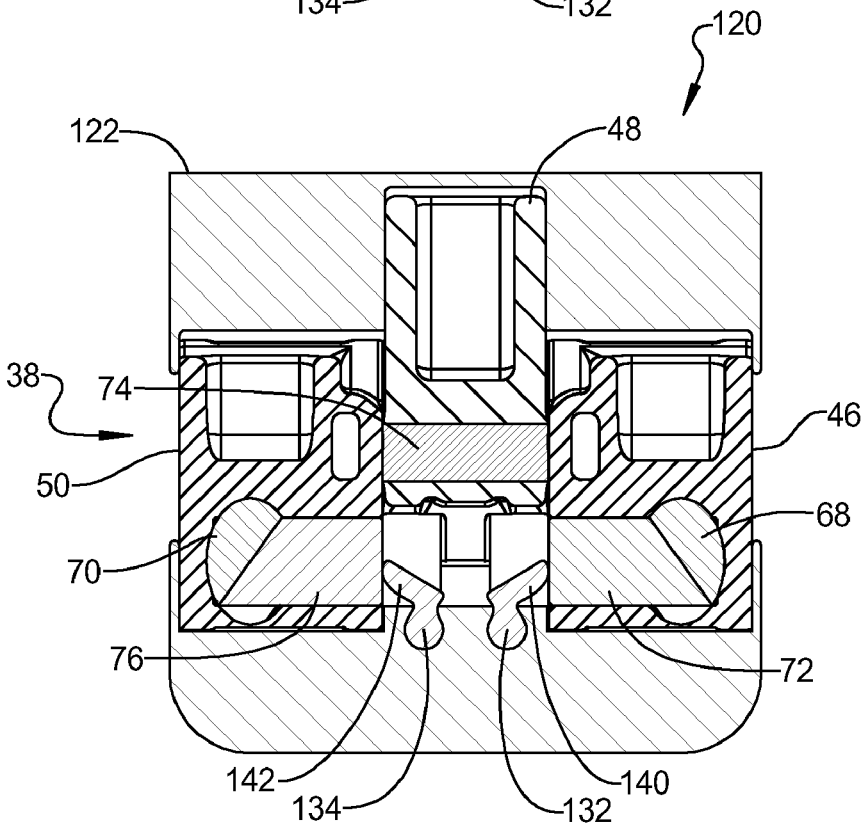
FIG 10

ENGINE HAVING VARIABLE LIFT VALVETRAIN

FIELD

The present disclosure relates to engines having variable valve lift mechanisms.

BACKGROUND

This section provides background information related to the present disclosure which is not necessarily prior art.

Engine assemblies may include multi-step lift mechanisms to provide variable valve lift during engine operation. The multi-step lift mechanism may be actuated by a hydraulic system to switch between the various lift modes. The use of hydraulic actuation may increase oil demand for an engine, resulting in increased oil pump size and/or the inclusion of additional hydraulic systems.

SUMMARY

An engine assembly may include an engine structure, a camshaft, a rocker arm, a locking assembly and an actuation assembly. The camshaft may be rotationally supported on the engine structure and may define a longitudinally extending rotational axis and may include first and second cam lobes. The rocker arm may be rotationally supported on the engine structure.

The rocker arm may include first and second arms. The first arm may be engaged with the first lobe of the camshaft and a first engine valve and may define a first longitudinal bore. The second arm may be adjacent the first arm and engaged with the second lobe of the camshaft and may define a second longitudinal bore. The locking assembly may include a first actuation pin extending through a first radial passage in the rocker arm, a second actuation pin extending through a second radial passage in the rocker arm, and a first lock pin located in the first longitudinal bore between the first and second actuation pins. The actuation assembly may be linearly displaceable between first and second actuation positions and may include a first actuation member engaged with the first actuation pin and a second actuation member engaged with the second actuation pin. The first and second arms may be rotatable relative to one another when the actuation assembly is in the first actuation position and may be fixed for rotation with one another by the first lock pin when the actuation assembly is in the second actuation position.

The rocker arm may additionally include a third arm engaged with a third lobe of the camshaft and a second engine valve and may define a third longitudinal bore. The locking assembly may include a second lock pin located in the second longitudinal bore. The second lock pin may be located in the second and third longitudinal bores to fix the second and third arms for rotation with one another when the actuation assembly is in the second actuation position.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

FIG. 4 is a fragmentary section view of the valve actuation assembly of FIG. 3 in a first position;

FIG. 5 is a fragmentary section view of the valve actuation assembly of FIG. 3 in a second position;

FIG. 6 is a fragmentary section view of the valve actuation assembly of FIG. 3 in a third position;

FIG. 7 is a perspective view of an installation tool according to the present disclosure;

FIG. 9 is a section view of the installation tool of FIG. 7 and the valve actuation assembly of FIG. 3; and FIG. 10 is an additional section view of the installation tool of FIG. 7 and the valve actuation assembly of FIG. 3.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
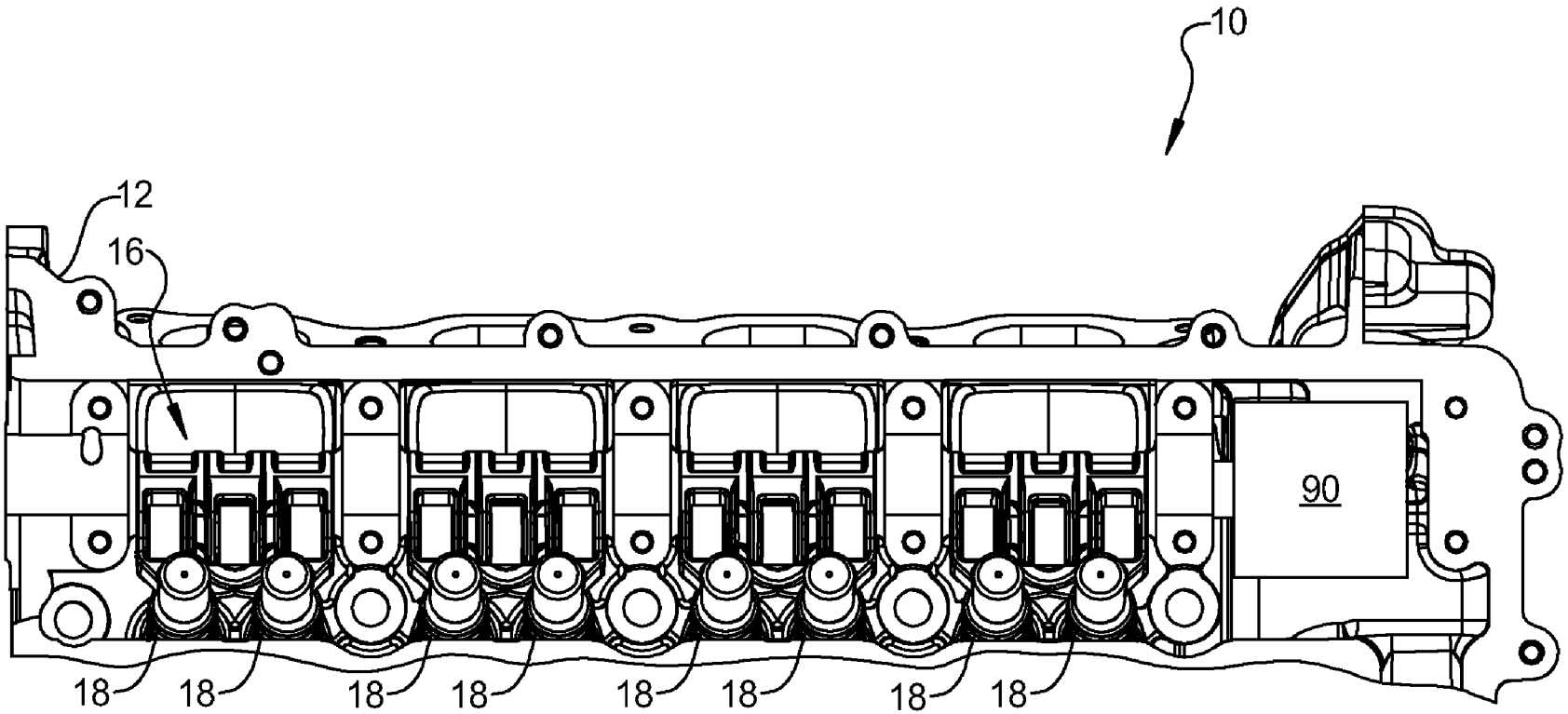
FIG. 1 is a fragmentary plan view of an engine assembly according to the present disclosure.
Figure 2:
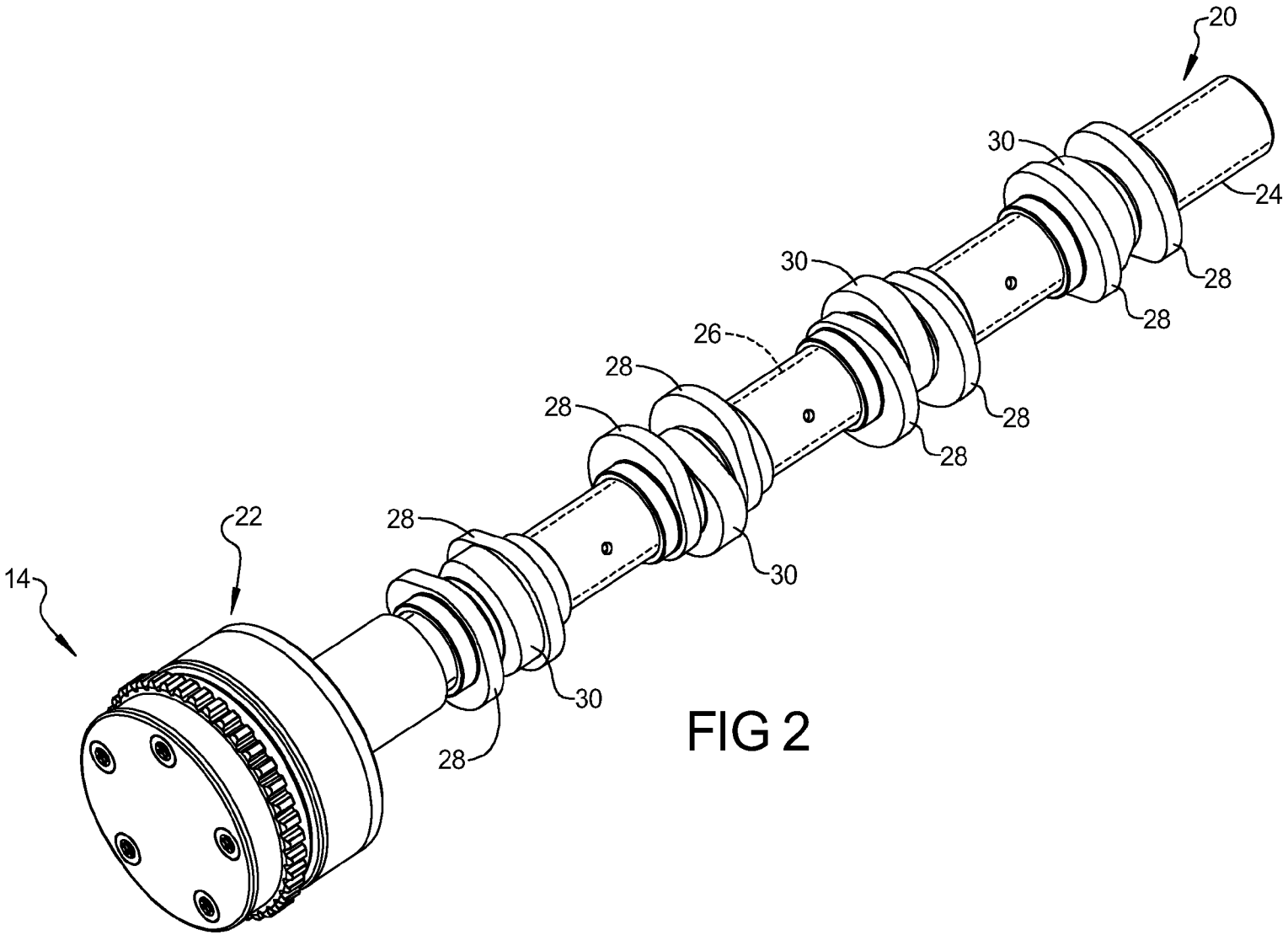
FIG. 2 is a perspective view of a camshaft assembly according to the present disclosure.

With reference to FIGS. 1 and 2, an engine assembly 10 is illustrated. The engine assembly 10 may include an engine structure 12, a camshaft assembly 14, a valve actuation assembly 16 and valves 18. The camshaft assembly 14 (FIG. 2) has been removed from the engine structure in FIG. 1 in order to better illustrate the valve actuation assembly 16. In the present non-limiting example, the engine assembly 10 is shown as an overhead camshaft engine. However, the present disclosure is not limited to overhead camshaft arrangements and applies equally to cam-in-block arrangements where a single camshaft includes both intake and exhaust lobes. It is further understood that the present disclosure applies equally to intake and exhaust valve actuation assemblies.

The engine structure 12 may include a cylinder head rotationally supporting the camshaft assembly 14 and supporting the valve actuation assembly 16 and valves 18. The camshaft assembly 14 may include a camshaft 20 and a cam phaser assembly 22. The camshaft 20 may form a concentric camshaft including first and second shafts 24, 26 and first and second sets of lobes 28, 30. The second shaft 26 may be coaxial with and rotatable relative to the first shaft 24. More specifically, the second shaft 26 may be rotationally supported within the first shaft 24.

The first set of lobes 28 may be fixed for rotation with the first shaft 24 and the second set of lobes 30 may be rotatable relative to the first shaft 24 and fixed for rotation with the second shaft 26. In the present non-limiting example, the first and second sets of lobes 28, 30 are illustrated as either all intake lobes or all exhaust lobes. However, as indicated above, the present disclosure is not limited to such arrangements and applies equally to configurations where the lobes form both intake and exhaust lobes.

The cam phaser assembly 22 may be coupled to the camshaft 20 to rotate the first and second lobes 28, 30 relative to one another. However, the present disclosure is not limited to engines including cam phasers. It is further understood that the present disclosure is not limited to concentric camshaft arrangements and applies equally to camshafts where the first and second lobes 28, 30 are rotationally fixed relative to one another.

Figure 3:
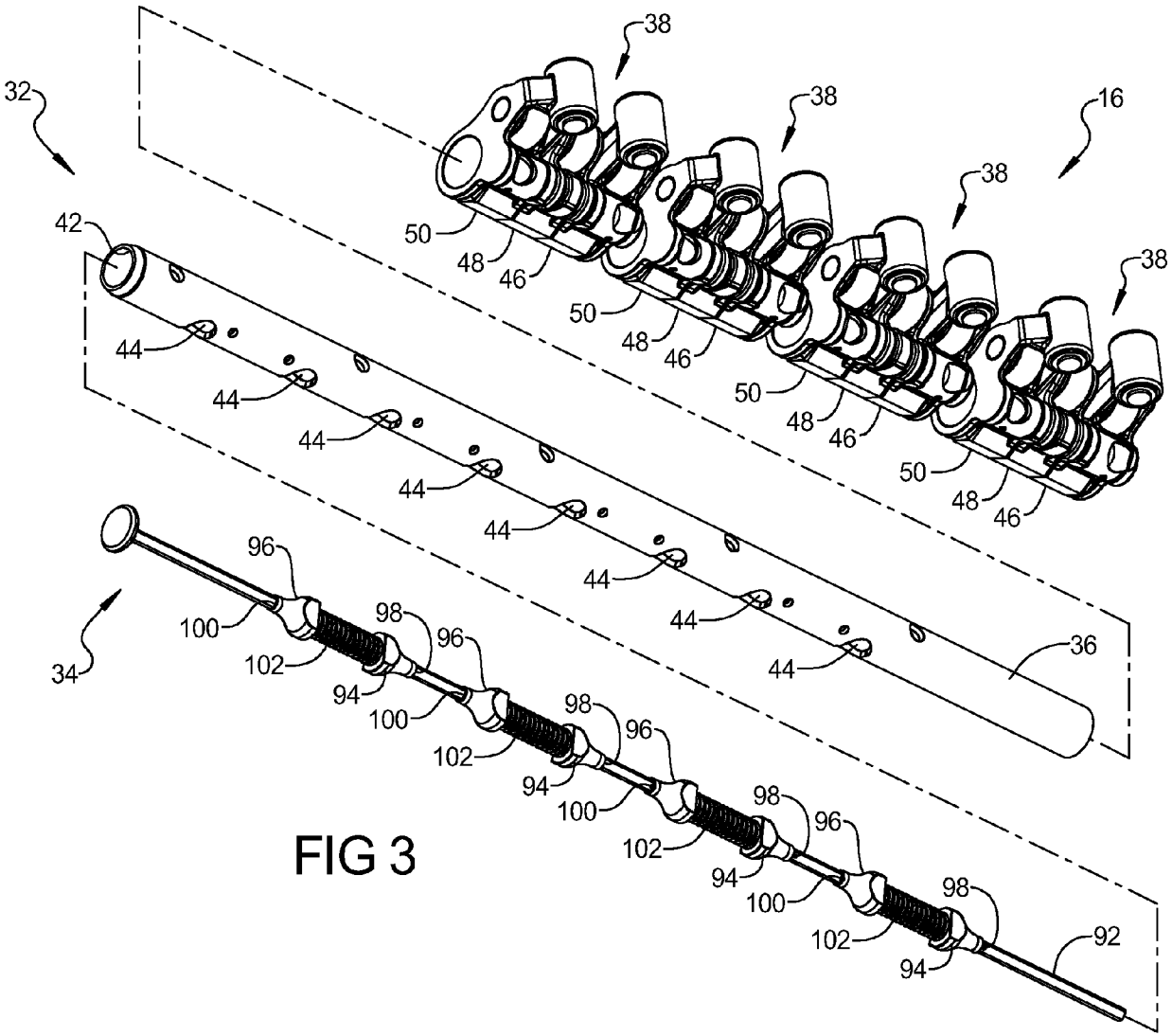
FIG. 3 is an exploded perspective view of the valve actuation assembly of FIG. 1.
Figure 8:
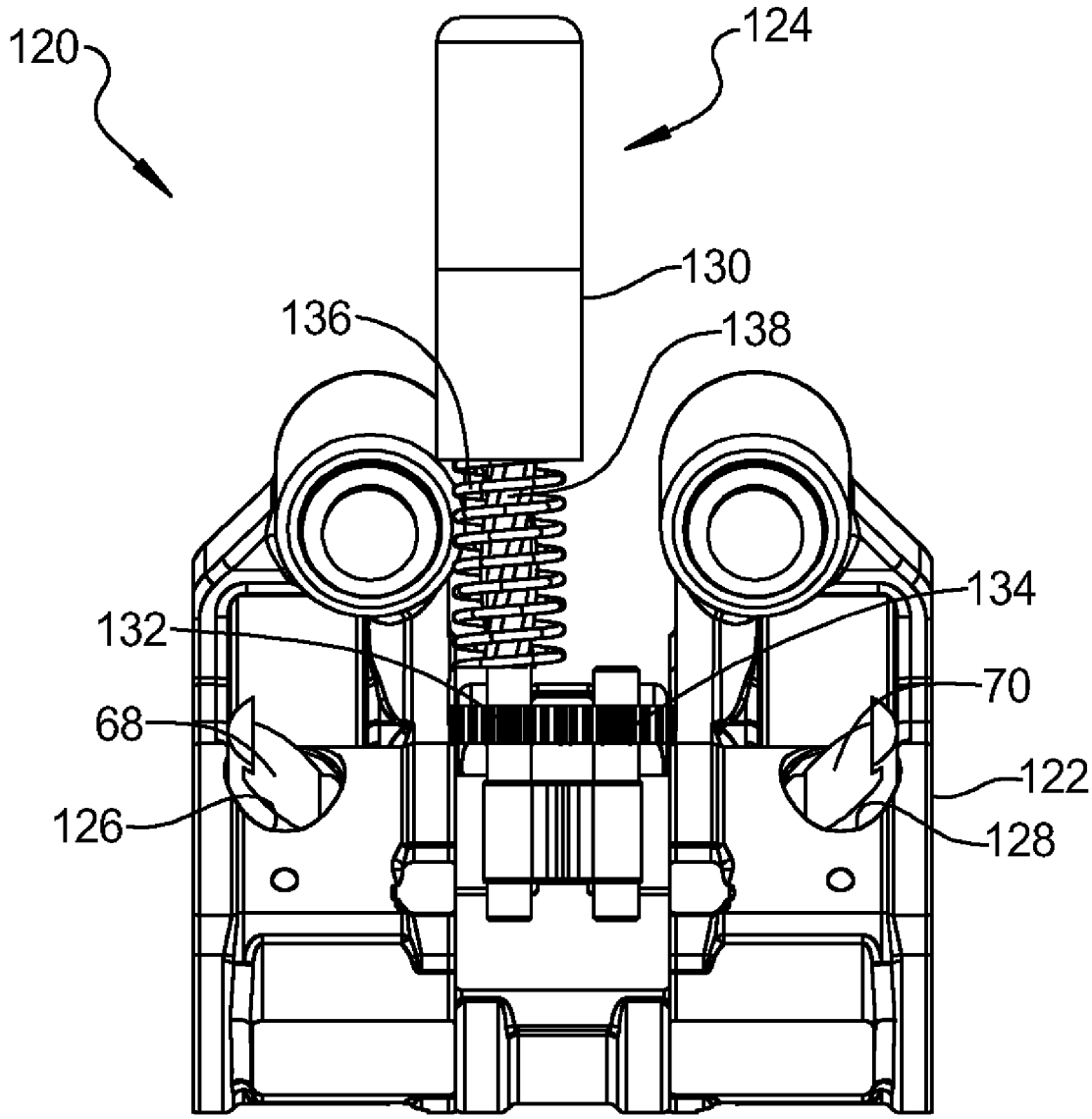
FIG. 8 is a view of a portion of the installation tool of FIG. 7 and the valve actuation assembly of FIG. 3.

With reference to FIGS. 1 and 3, the valve actuation assembly 16 may include a valve lift assembly 32 and an actuation assembly 34. The valve lift assembly 32 may include a shaft 36 mounted to the engine structure 12, rocker arms 38 rotationally supported on the shaft 36, and a locking assembly 40 located within the rocker arms 38. The shaft 36 may define a longitudinal bore 42 and arcuate slots 44 extending radially through an outer circumferential surface into the bore 42.

With additional reference to FIGS. 4-6, the rocker arms 38 may each include first, second, and third arms 46, 48, 50. The second arm 48 may be located axially between the first and third arms 46, 50. The first and third arms 46, 50 may be engaged with the first lobes 28 of the camshaft 20 and the second arms 48 may be engaged with the second lobes 30 of the camshaft 20. The first, second, and third arms 46, 48, 50 may include mounting bores 52, 54, 56, respectively, at first ends thereof and the first and third arms 46, 50 may include valve engagement regions 58, 60, respectively, at second ends thereof. The shaft 36 may extend through the mounting bores 52, 54, 56 and rotationally support the rocker arm 38 thereon. While illustrated as including three arms, it is understood that the present disclosure is not limited to such arrangements. By way of non-limiting example, the present disclosure applies equally to arrangements having two arms.

Additionally, the first arm 46 may define a first longitudinal bore 62, the second arm 48 may define a second longitudinal bore 64, and the third arm 50 may define a third longitudinal bore 66. The shaft 36, mounting bores 52, 54, 56 and first, second, and third longitudinal bores 62, 64, 66 may be parallel to the rotational axis of the camshaft 20. The locking assembly 40 may be located in the first, second and third longitudinal bores 62, 64, 66. The locking assembly 40 may include first and second actuation pins 68, 70 and first, second and third lock pins 72, 74, 76. The first and second actuation pins 68, 70 may be perpendicular to the first, second and third lock pins 72, 74, 76. The first actuation pin 68 may extend through a first radial passage 78 in the rocker arm 38 and the second actuation pin 70 may extend through a second radial passage 80 in the rocker arm 38. In the present non-limiting example, the first radial passage 78 is defined in the first arm 46 and extends into the first longitudinal bore 62 and the second radial passage 80 is defined in the third arm 50 and extends into the third longitudinal bore 66. The first and second radial passages 78, 80 may be aligned with corresponding slots 44 in the shaft 36.

The first lock pin 72 may be located between and engaged with the first actuation pin 68 and the second lock pin 74. The third lock pin 76 may be located between and engaged with the second actuation pin 70 and the second lock pin 74. In the present non-limiting example, the first actuation pin 68 includes a ramped (angled) surface 82 engaged with a ramped (angled) surface 84 on a first end of the first lock pin 72 to translate radial displacement of the first actuation pin 68 into axial displacement of the first lock pin 72. Similarly, the second actuation pin 70 includes a ramped surface 86 engaged with a ramped surface 88 on a first end of the third lock pin 76 to translate radial displacement of the second actuation pin 70 into axial displacement of the third lock pin 76. A first end of the second lock pin 74 may be engaged with the first lock pin 72 and a second end of the second lock pin 74 may be engaged with the third lock pin 76.

With reference to FIGS. 1 and 3, the actuation assembly 34 may include an actuator 90, an actuation rod 92, first and second actuation members 94, 96, first and second stop members 98, 100 and biasing members 102. The actuator 90 may be engaged with the actuation rod 92 and may provide linear displacement of the actuation rod 92. In the present non-limiting example, the actuator 90 is an electric motor. The use of an electric motor may provide a more robust system that is insensitive to oil pressure fluctuations (i.e., at start-up/shut-down or hot/cold operating conditions). However, the present disclosure is not limited to such arrangements and applies equally to any actuator capable of providing linear displacement of the actuation rod 92. The actuation members 94, 96, first and second stop members 98, 100 and biasing members 102 may be similar along the actuation rod 92. Therefore, a single first actuation member 94, second actuation member 96, first stop member 98, second stop member 100 and biasing member 102 will be described.

With reference to FIGS. 4-6, the first and second actuation members 94, 96 may be located on the actuation rod 92 between the first and second stop members 98, 100 and the biasing member 102 may be located between the first and second actuation members 94, 96. The first and second stop members 98, 100 may be axially fixed to the actuation rod 92. The first and second actuation members 94, 96 may be slidably disposed on the actuation rod 92 between the first and second stop members 98, 100. The biasing member 102 may urge the first and second actuation members 94, 96 outward from one another. More specifically, the biasing member 102 may urge the first actuation member 94 toward the first stop member 98 and the second actuation member toward the second stop member 100. The first actuation member 94 may include a ramped (angled) surface 104 expanding radially outward along its axial extent in a direction from the first stop member 98 to the second stop member 100 and the second actuation member 96 may include a ramped surface 106 expanding radially outward along its axial extent in a direction from the second stop member 100 to the first stop member 98.

During operation, the rocker arms 38 may be switched between first and second lift modes by the actuation assembly 34. The first lift mode may provide a first valve opening and the second lift mode may provide a second valve opening that is different than the first valve opening. In the present non-limiting example, the first lobes 28 may displace the first and third arms 46, 50 relative to the second arm 48 during the first lift mode and the second lobes 30 may displace the first, second and third arms 46, 48, 50 with one another during the second lift mode. The default (initial) lift mode may be varied by changing the starting location of the actuation rod 92.

Linear displacement of the actuation rod 92 may switch the rocker arms 38 between first and second lift modes. The first lift mode is illustrated in FIG. 4 and the second lift mode is illustrated in FIG. 6. FIG. 5 illustrates a transition between the first and second lift modes. As seen in FIG. 4, the first and second actuation pins 68, 70, and the first, second and third lock pins 72, 74, 76 may be in a first lock position during the first lift mode. In the first lock position, the end of the first lock pin 72 engaged with the second lock pin 74 may be located outside of the second longitudinal bore 64 and the end of the second lock pin 74 engaged with the third lock pin 76 may be located outside of the third longitudinal bore 66 to provide relative rotation between the first, second and third arms 46, 48, 50.

As seen in FIG. 6, the first and second actuation pins 68, 70, and the first, second and third lock pins 72, 74, 76 may be in a second lock position during the second lift mode. In the second lock position, the first lock pin 72 may be located in both the first and second longitudinal bores 62, 64 and the second lock pin 74 may be located in both the second and third longitudinal bores 64, 66 to fix the first, second and third arms 46, 48, 50 for rotation with one another. More specifically, the end of the first lock pin 72 engaged with the second lock pin 74 may be located within the second longitudinal bore 64 and the end of the second lock pin 74 engaged with the third lock pin 76 may be located within the third longitudinal bore 66 when in the second lock position.

The first actuation pin 68 may be located radially outward relative to the first lock position when in the second lock position and the second actuation pin 70 may be located radially outward relative to the second lock position when in the first lock position. The outward radial displacement of the first actuation pin 68 may displace the first, second and third lock pins 72, 74, 76 axially to switch from the first lift mode to the second lift mode. The axial displacement of the first, second and third lock pins 72, 74, 76 may displace the second actuation pin 70 radially inward. The first actuation pin 68 may be displaced by the first actuation member 94. The actuation rod 92 may be displaced from a first actuation position to a second actuation position to displace the locking assembly 40 from the first lock position to the second lock position. The actuation rod 92 may be displaced from the second actuation position to the first actuation position to return the locking assembly 40 to the first lock position.

In the first actuation position, seen in FIG. 4, the first actuation pin 68 may be engaged with a first region of the first actuation member 94 and the second actuation pin 70 may be engaged with a first region of the second actuation member 96. In the second actuation position, seen in FIG. 6, the actuation rod 92 may be linearly displaced relative to the first actuation position, displacing the first and second actuation members 94, 96 relative to the first and second actuation pins 68, 70 and providing engagement between the first actuation pin 68 and a second region of the first actuation member 94 and engagement between the second actuation pin 70 and a second region of the second actuation member 96.

The second region of the first actuation member 94 may have a greater radial extent than the first region thereof and the second region of the second actuation member 96 may have a lesser radial extent than the first region thereof. As a result, the first actuation member 94 may displace the first actuation pin 68 radially outward as the first actuation pin 68 travels along the ramped surface 104 from the first region to the second region. The outward radial displacement of the first actuation pin 68 displaces the first, second and third lock pins 72, 74, 76 into the second lock position and displaces the second actuation pin 70 radially inward. When the actuation rod 92 is displaced back to the first actuation position, the first, second and third lock pins 72, 74, 76 may be returned to the first lock position by the second actuation pin 70.

As seen in FIG. 5, the actuation assembly 34 may provide a transition between the first and second actuation positions when the rocker arm 38 is in the second lift mode and the first and third arms 46, 50 are displaced relative to the second arm 48. When first and third arms 46, 50 are displaced relative to the second arm 48, the first and third longitudinal bores 62, 66 may not be aligned with the second longitudinal bore 64 due to an engagement with a peak region of the first lobes 28, preventing axial displacement of the first lock pin 72 into the second longitudinal bore 64 and displacement of the second lock pin 74 into the third longitudinal bore 66. When the actuation rod 92 is displaced to the second actuation position during the misalignment condition discussed above, the first actuation member 94 may remain in the first actuation position.

The displacement of the action rod 92 displaces the first and second stop members 98, 100 and the second actuation member 96, compressing the biasing member 102 and urging the first actuation member 94 outward against the first actuation pin 68. When the first, second and third longitudinal bores 62, 64, 66 are aligned again (i.e., when the first and third arms 46, 50 are engaged with a base circle region of the first lobes 28), the first actuation member 94 is displaced by the biasing member 102 and forces the first actuation pin 68 radially outward, displacing the first, second and third lock pins 72, 74, 76 and the second actuation pin 70 to the second lock position.

The valve actuation assembly 16 may be assembled using the tool 120 illustrated in FIGS. 7-10. The tool 120 may define a rocker arm housing 122 receiving the rocker arm 38 and a coupling mechanism 124. The rocker arm 38 may contain the locking assembly 40 before being located in the rocker arm housing 122. The rocker arm 38 may be secured to the tool 120 via an engagement between the locking assembly 40 and the coupling mechanism 124 of the tool 120.

The mounting bores 52, 54, 56 of the first, second and third arms 46, 48, 50 may be aligned with one another and the second longitudinal bore 64 of the second arm 48 may be offset from the first and third longitudinal bores 62, 66. The first lock pin 72 may be located in the first longitudinal bore 62 and the third lock pin 76 may be in the third longitudinal bore 66 when the rocker arm 38 is in the rocker arm housing 122. The first and third lock pins 72, 76 may initially extend inward from the first and third longitudinal bores 62, 66 toward one another. The second lock pin 74 may be located in the second longitudinal bore 64.

In the present non-limiting example, the rocker arm 38 may define additional radial passages 126, 128 opposite the first and second radial passages 78, 80, respectively. When the locking assembly 40 is secured in the rocker arm housing 122, the first actuation pin 68 may extend through the radial passage 126 and the second actuation pin 70 may extend through the radial passage 128.

The coupling mechanism 124 may include actuation member 130 and first and second gear members 132, 134. The actuation member 130 may include a shaft 136 having a helical gear 138 engaged with the first gear member 132 and the first gear member 132 may be engaged with the second gear member 134. The first gear member 132 may include a first arm 140 engaged with the first lock pin 72 and the second gear member 134 may include a second arm 142 engaged with the third lock pin 76.

During assembly, the tools 120 and rocker arms 38 may be positioned relative to the engine structure 12 to provide alignment between bores (not shown) in the engine structure 12 and the mounting bores 52, 54, 56 of the rocker arms 38. The shaft 42 may then be inserted into the bores in the engine structure 12 and the mounting bores 52, 54, 56 of the rocker arms 38. The actuation assembly 34 may be located within the shaft bore 42 before or after installation of the shaft 36.

After the shaft 36 is inserted into the bores in the engine structure 12 and the mounting bores 52, 54, 56 of the rocker arms 38, the actuation member 130 may be depressed, resulting in rotation of the first and second gear members 132, 134 from a first position (FIG. 9) to a second position (FIG. 10). As the first and second gear members 132, 134 are rotated, the first and second arms 140, 142 displace the first and third lock pins 72, 76 outward from one another and the first and second actuation pins 68, 70 radially into the shaft bore 42. The second arm 48 may then be rotated to provide alignment between the first, second and third longitudinal bores 62, 64, 66. The assembly tool 120 may then be removed from the rocker arm 38.

The terms "first", "second", etc. are used throughout the description for clarity only and are not intended to limit similar terms in the claims.

What is claimed is:

1. An engine valve actuation assembly comprising:

a shaft adapted to be coupled to an engine structure and defining a shaft bore:

a rocker arm rotationally supported on an outer surface of the shaft and including:

a first arm adapted to engage a first lobe of a camshaft and a first engine valve and defining a first longitudinal bore; and a second arm adjacent the first arm, adapted to engage a second lobe of the camshaft and defining a second longitudinal bore;

a locking assembly including a first actuation pin extending through a first radial passage in the rocker arm, a second actuation pin extending through a second radial passage in the rocker arm, and a first lock pin located in the first longitudinal bore between the first and second actuation pins; and an actuation assembly located in the shaft bore, being linearly displaceable between first and second actuation positions and including a first actuation member supported on an actuation rod and engaged with the first actuation pin and a second actuation member supported on the actuation rod and engaged with the second actuation pin, the first and second arms being rotatable relative to one another when the actuation assembly is in the first actuation position and being fixed for rotation with one another by the first lock pin when the actuation assembly is in the second actuation position.

2. The valve actuation assembly of claim 1, wherein the first lock pin is located within the first and second longitudinal bores when the actuation assembly is in the second actuation position to fix the first and second arms for rotation with one another.

3. The valve actuation assembly of claim 2, wherein the locking assembly includes a second lock pin located in the second longitudinal bore between the first lock pin and the second actuation pin.

4. The valve actuation assembly of claim 3, wherein the rocker arm includes a third arm and the locking assembly includes a third lock pin, the third arm adapted to engage a third lobe on the camshaft and a second engine valve and defining a third longitudinal bore, the third lock pin being located in the third longitudinal bore and the second lock pin being located within the second and third longitudinal bores and fixing the second and third arms for rotation with one another when the actuation assembly is in the second actuation position.

5. The valve actuation assembly of claim 2, wherein the first actuation pin and the first lock pin include angled surfaces abutting one another and providing axial displacement of the first lock pin via radial displacement of the first actuation pin, the first and second actuation pins and the first lock pin being in a first lock position when the actuation assembly is in the first actuation position and being in a second lock position when the actuation assembly is in the second actuation position, the first actuation pin being located radially outward relative to the first lock position when in the second lock position and the second actuation pin being located radially inward relative to the first lock position when in the second lock position.

6. The valve actuation assembly of claim 1, wherein the first and second actuation members are slidably disposed on the actuation rod.

7. The valve actuation assembly of claim 6, wherein the actuation assembly includes first and second stop members and a biasing member, the first and second stop members fixed for axial displacement with the actuation rod, the first and second actuation members located axially between the first and second stop members and the biasing member located axially between the first and second actuation members and urging the first actuation member toward the first stop member and the second actuation member toward the second stop member.

8. The valve actuation assembly of claim 1, wherein the first and second actuation pins are perpendicular to the first lock pin.

9. The valve actuation assembly of claim 1, wherein the shaft bore and the first and second longitudinal bores are parallel to a rotational axis of the camshaft.

10. An engine assembly comprising:

an engine structure;

a camshaft rotationally supported on the engine structure, defining a longitudinally extending rotational axis and including first and second cam lobes;

a shaft fixed to the engine structure and defining a shaft bore;

a rocker arm rotationally supported on an outer surface of the shaft and including:

a first arm engaged with the first cam lobe and a first engine valve and defining a first longitudinal bore; and a second arm adjacent the first arm, engaged with the second cam lobe and defining a second longitudinal bore;

a locking assembly including a first actuation pin extending through a first radial passage in the rocker arm, a second actuation pin extending through a second radial passage in the rocker arm, and a first lock pin located in the first longitudinal bore between the first and second actuation pins; and an actuation assembly located in the shaft bore, being linearly displaceable between first and second actuation positions and including a first actuation member supported on an actuation rod and engaged with the first actuation pin and a second actuation member supported on the actuation rod and engaged with the second actuation pin, the first and second arms being rotatable relative to one another when the actuation assembly is in the first actuation position and being fixed for rotation with one another by the first lock pin when the actuation assembly is in the second actuation position.

11. The engine assembly of claim 10, wherein the first lock pin is located within the first and second longitudinal bores when the actuation assembly is in the second actuation position to fix the first and second arms for rotation with one another.

12. The engine assembly of claim 11, wherein the locking assembly includes a second lock pin located in the second longitudinal bore between the first lock pin and the second actuation pin.

13. The engine assembly of claim 11, wherein the first actuation pin and the first lock pin include angled surfaces abutting one another and providing axial displacement of the first lock pin via radial displacement of the first actuation pin, the first and second actuation pins and the first lock pin being in a first lock position when the actuation assembly is in the first actuation position and being in a second lock position when the actuation assembly is in the second actuation position, the first actuation pin being located radially outward relative to the first lock position when in the second lock position and the second actuation pin being located radially inward relative to the first lock position when in the second lock position.

14. The engine assembly of claim 10, wherein the first and second actuation members slidably disposed on the actuation rod.

15. The engine assembly of claim 14, wherein the actuation assembly includes first and second stop members and a biasing member, the first and second stop members fixed for axial displacement with the actuation rod, the first and second actuation members located axially between the first and second stop members and the biasing member located axially between the first and second actuation members and urging the first actuation member toward the first stop member and the second actuation member toward the second stop member.

16. The engine assembly of claim 10, wherein the first and second actuation pins are perpendicular to the first lock pin.

17. The engine assembly of claim 10, wherein the shaft bore and the first and second longitudinal bores are parallel to the rotational axis of the camshaft.

18. An engine assembly comprising:

an engine structure;

a camshaft rotationally supported on the engine structure, defining a longitudinally extending rotational axis and including first, second and third cam lobes;

a shaft fixed to the engine structure and defining a shaft bore;

a rocker arm rotationally supported on an outer surface of the shaft and including:

a first arm engaged with the first cam lobe and a first engine valve and defining a first longitudinal bore;

a second arm engaged with the second cam lobe and defining a second longitudinal bore; and a third arm engaged with the third cam lobe and a second engine valve and defining a third longitudinal bore, the second arm located between the first and third arms;

a locking assembly including a first actuation pin extending through a first radial passage in the rocker arm, a second actuation pin extending through a second radial passage in the rocker arm, a first lock pin located in the first longitudinal bore, a second lock pin located in the second longitudinal bore and a third lock pin located in the third longitudinal bore, the first, second, and third lock pins located between the first and second actuation pins; and an actuation assembly located in the shaft bore, being linearly displaceable between first and second actuation positions and including a first actuation member supported on an actuation rod and engaged with the first actuation pin and a second actuation member supported on the actuation rod and engaged with the second actuation pin, the first and third arms being rotatable relative to the second arm when the actuation assembly is in the first actuation position and being fixed for rotation with one another by the first lock pin being located in the first and second longitudinal bore and the second lock pin being located in the second and third longitudinal bores when the actuation assembly is in the second actuation position.

19. The valve actuation assembly of claim 1, wherein the first and second actuation pins are oriented parallel to one another.

20. The engine assembly of claim 10, wherein the first and second actuation pins are oriented parallel to one another.

* * * * *